US007987681B2

(12) United States Patent
Cochran

(10) Patent No.: US 7,987,681 B2
(45) Date of Patent: Aug. 2, 2011

(54) REFRIGERANT FLUID FLOW CONTROL DEVICE AND METHOD

(75) Inventor: Robert W. Cochran, Lakeland, FL (US)

(73) Assignee: Earthlinked Technologies, Inc., Lakeland, FL (US)

( * ) Notice: Subject to any disclaimer, the term of this patent is extended or adjusted under 35 U.S.C. 154(b) by 238 days.

(21) Appl. No.: 11/551,324

(22) Filed: Oct. 20, 2006

(65) Prior Publication Data

US 2007/0119208 A1 May 31, 2007

Related U.S. Application Data

(60) Provisional application No. 60/728,619, filed on Oct. 20, 2005.

(51) Int. Cl.
*F25B 41/04* (2006.01)
*F25B 41/00* (2006.01)

(52) U.S. Cl. ..... 62/222; 62/225; 62/210

(58) Field of Classification Search ..... 62/527, 62/222; 236/92 B, 93 A, 99 R, 99 J; 251/127; 137/468

See application file for complete search history.

(56) References Cited

U.S. PATENT DOCUMENTS 3,399,543 A * 9/1968 Matthies ..... 62/202
3,699,778 A * 10/1972 Orth ..... 62/225
3,804,326 A 4/1974 McIntire
3,930,613 A 1/1976 Place
3,978,891 A * 9/1976 Vick ..... 138/42
4,032,071 A 6/1977 Imoto
4,079,886 A 3/1978 Pauli
4,133,478 A 1/1979 Place
4,339,075 A 7/1982 Schittek et al.
4,474,022 A 10/1984 Puskar
4,788,828 A * 12/1988 Sato ..... 62/214
4,979,372 A * 12/1990 Tanaka ..... 62/225
5,025,634 A 6/1991 Dressler
5,156,017 A 10/1992 Smith et al.
5,177,973 A 1/1993 Cholkeri et al.
5,201,190 A * 4/1993 Nelson et al. ..... 62/210
5,269,459 A 12/1993 Thompson et al.
5,438,846 A * 8/1995 Datta ..... 62/238.7
5,461,876 A 10/1995 Dressler (Continued)

OTHER PUBLICATIONS

McQuiston et al., Heating, Ventilating, and Air Conditioning Analysis and Design, 2005, John Wiley and Sons, Inc., 6th edition, p. 41 Section 2-8.*

*Primary Examiner* — Frantz F Jules
*Assistant Examiner* — Cassey Bauer
(74) *Attorney, Agent, or Firm* — Allen, Dyer, Doppelt, Milbrath & Gilchrist, P.A.

(57) ABSTRACT

A subcool flow control valve useful in a refrigerant system includes an enclosure having a fluid flow pathway for a controlled fluid between an inlet and an outlet. A thermally conductive flexible wall forms a sealed cavity within the enclosure for carrying a controlling fluid. A metering orifice operable between the pathway and the outlet port controls an amount of metered fluid passing through the outlet port in response to movement of the flexible wall toward and away from the metering orifice in response to temperature changes of the controlled fluid transmitting temperature and thus pressure changes to the controlling fluid in the sealed cavity. Inverse thermal feedback means is formed as part of the valve for stabilizing valve operation thus providing means for transmitting a thermal signal from the metered controlled fluid back to the controlling fluid.

33 Claims, 11 Drawing Sheets

U.S. PATENT DOCUMENTS 5,642,858 A 7/1997 Kakehashi et al.
5,953,926 A 9/1999 Dressler et al.
5,996,900 A * 12/1999 Ise ..... 236/92 B
6,012,300 A 1/2000 Tomatsu et al.
6,105,379 A 8/2000 Alsenz et al.
6,129,331 A * 10/2000 Henning et al. ..... 251/11
6,149,123 A 11/2000 Harris et al.
6,293,472 B1 9/2001 Yano
6,321,995 B1 11/2001 Badovick et al.
6,450,412 B1 9/2002 Cessac
6,450,413 B2 9/2002 Yano
6,484,653 B2 11/2002 Swanson
6,484,950 B2 11/2002 Hirota et al.
7,363,940 B2 * 4/2008 Oberley et al. ..... 137/513.3
2001/0010158 A1 * 8/2001 Bascobert ..... 62/217
2001/0027662 A1 * 10/2001 Yano ..... 62/404
2002/0023460 A1 2/2002 Minowa et al.
2002/0060250 A1 5/2002 Hirota et al.
2003/0010833 A1 1/2003 Hotta et al.
2003/0091478 A1 5/2003 Jackson
2004/0016260 A1 1/2004 Kobayashi et al.
2004/0237548 A1 * 12/2004 Ben Yahia ..... 62/222
2005/0193562 A1 * 9/2005 Andra et al. ..... 29/890.122

* cited by examiner

REFRIGERANT FLUID FLOW CONTROL DEVICE AND METHOD

CROSS REFERENCE TO RELATED APPLICATION

This application claims the benefit of U.S. Provisional Application No. 60/728,619 for "Refrigerant Flow Control Device and Method" having filing date of Oct. 20, 2005, the disclosure of which is hereby incorporated by reference herein in its entirety, and all commonly owned.

FIELD OF INVENTION

The present invention generally relates to refrigeration systems, and in particular relates to a subcooling control valve for controlling refrigerant fluid flow.

SUMMARY

A refrigerant flow control device provides simplicity, improved stability and reliability in a refrigerant circuit. The present invention provides a simplified and reliable, subcool control valve that may include inverse thermal feedback and/or other means for improved stability in a refrigerant circuit, and further may provide use of a conventional subcool valve using inverse thermal feedback for improved refrigerant circuit stability and subcool control. Subcooling is well known in the art and is herein defined as the amount of cooling of a liquid refrigerant in a condenser after it finishes condensing from a vapor to a liquid in the condenser.

One embodiment of the present invention may include a fluid flow control valve for use in a refrigerant circuit, the valve may comprise a single enclosure having two discrete portions including a sealed cavity with a controlling fluid confined therein, the cavity including a single flexible wall member that is thermally conductive, and a pathway for a controlled fluid, including an inlet, thermal contact of the controlled fluid with the flexible wall member, and a metering outlet, such that an increase in temperature of the controlled fluid results in an increase in temperature and pressure of the controlling fluid, and a decrease in temperature of the controlled fluid results in a decrease in temperature and pressure of the controlling fluid, thereby causing the pressure in the sealed cavity to increase when the controlled fluid becomes warmer, and causing the pressure in the sealed cavity to decrease when the controlled fluid becomes cooler. This forces the flexible wall member to move closer to the metering orifice and reduce the rate of fluid flow when the controlled fluid becomes warmer, and forces the flexible wall member to move farther from a metering orifice and increase the rate of fluid flow when the controlled fluid becomes cooler. The controlled fluid temperature, relative to the controlled fluid pressure, may thus determine the rate of flow for the controlled fluid, such that the rate of flow of the controlled fluid is determined by the amount of subcooling present in the controlled fluid. The controlling fluid may typically be a refrigerant identical to the controlled fluid. A predetermined amount of subcooling may thus be as provided by the valve. This predetermined amount of subcooling may be controlled and adjusted by a variety of means, including the thickness and/or flexibility of the flexible wall, and/or the proximity of the flexible wall to the metering orifice.

An embodiment of the present invention may include a fluid flow control valve having inverse thermal feedback for stabilizing the operation of the valve in refrigerant circuits that are inherently unstable. Inverse thermal feedback may be defined as means to transmit a thermal signal from a metered and colder controlled fluid back to the controlling fluid.

Another embodiment may include a compressor, a condenser, and an evaporator, for operation as an air conditioner or heat pump. Yet another embodiment may include a compressor, a condenser, an evaporator, and an ACC (Active Charge Control) for operation as an air conditioner or heat pump.

An embodiment of the invention may include a refrigerant circuit having a compressor, a condenser, an evaporator, an active charge control, a subcool control valve, expansion means for expanding the metered refrigerant, said subcool control valve holding the amount of subcooling in the condenser and the amount of liquid refrigerant in the condenser at a fixed pre-determined amount, such that all inactive, non-circulating, liquid refrigerant is contained within the active charge control, and expanded refrigerant is transmitted to the evaporator at essentially the same pressure as in the evaporator. As a result the evaporator remains "flooded" throughout a range of loading of the heat pump thereby delivering refrigerant vapor with essentially zero superheat to the compressor inlet throughout the range of loading.

Yet further, an embodiment may include a single enclosure containing a sealed cavity with a controlling fluid confined therein, said cavity including a single flexible wall member that is thermally conductive; a pathway for a controlled fluid, including an inlet, thermal contact with the flexible wall member, a metering outlet, and refrigerant expansion means, such that an increase in temperature of the controlled fluid results in an increase in temperature and pressure of the controlling fluid, and a decrease in temperature of the controlled fluid results in a decrease in temperature and pressure of the controlling fluid, thereby causing the pressure in the sealed cavity to increase when the controlled fluid is warmer which forces the flexible wall member to move closer to the metering orifice and reduce the rate of fluid flow, and causing the pressure in the sealed cavity to decrease when the controlled fluid is cooler which forces the flexible wall member to move farther from the metering orifice and increase the rate of flow such that the rate of the flow of the controlled fluid is determined by the temperature of the controlled fluid, relative to the pressure of the controlled fluid, and therefore the rate of flow of the controlled fluid is determined by the amount of subcooling present in the controlled fluid, and further, including the expansion means operable with the metering orifice, such that the controlled fluid exits the enclosure expanded and at essentially the same pressure as in the evaporator.

Yet another embodiment may include a compressor, a condenser, an evaporator, an active charge control, and a fluid flow control valve including inverse thermal feedback wherein the valve maintains a pre-determined amount of liquid refrigerant in the condenser and therefore all inactive, non-circulating, liquid refrigerant in the system resides within an active charge control device, such that the amount of inactive liquid may be pre-determined, and the amount of subcooling in the condenser may be predetermined and preset at a desired value. Other stabilizing means as herein described may be included.

Yet another embodiment may include a refrigerant circuit for heating or cooling a fluid, which embodiment includes a subcool control valve with metering means comprising a minimum or bypass flow orifice operating in parallel with a metering orifice to prevent complete closure of said metering means, so as to preclude overshooting and hunting of the control valve, and possible shutdown of the refrigerant circuit.

Another embodiment of the subcool control valve may include a single enclosure containing a sealed cavity with a controlling fluid confined therein, and a single flexible wall member that is thermally conductive. A pathway for a controlled fluid extends between an inlet and an outlet for providing thermal contact of the controlled fluid with the flexible wall member, and a metering outlet, including a minimum flow orifice operating in parallel with a metering orifice, such that an increase in temperature of the controlled fluid results in an increase in temperature and pressure of the controlling fluid, and a decrease in temperature of the controlled fluid results in a decrease in temperature and pressure of the controlling fluid, thereby causing the pressure in the sealed cavity to increase when the controlled fluid is warmer, which forces the flexible wall member to move closer to the metering orifice and reduce the rate of fluid flow, and causing the pressure in the sealed cavity to decrease when the controlled fluid is cooler which forces the flexible wall member to move farther from the metering orifice and increase the rate of fluid flow, such that the minimum flow orifice reduces the rate of opening and rate of closing of the valve and prevents total closure of the valve, to improve valve stability and prevent shut-down of a refrigerant circuit due to rapid or complete closure of the valve. As above discussed, the rate of the flow of the controlled fluid may then be determined by the temperature of the controlled fluid, relative to the pressure of the controlled fluid, and amount of subcooling present in the controlled fluid. Other stabilizing means and/or refrigerant expansion means may also be provided for the subcool control valve.

By way of further example, an embodiment of the invention may include a flow control valve having inverse thermal feedback means comprising an expansion orifice operable between the metering orifice and the outlet port, the metering orifice and the expansion orifice extending through the enclosure for providing passage of the metered controlled fluid to the outlet port, wherein the expansion orifice results in an expanding metered controlled fluid placed in thermal contact with the enclosure for providing thermal feedback to the controlled fluid within the pathway and thus to the flexible wall member which in turn provides thermal feedback to the controlling fluid within the sealed cavity. The thermal feedback may be provided via the enclosure to a vaporized phase of the controlling fluid.

The subcool control valve may be contained within a system having a compressor, a condenser, and an evaporator operating as an air conditioner or heat pump. Yet another embodiment may include a compressor, a condenser, an evaporator, and an ACC (Active Charge Control) device for operation as an air conditioner or heat pump.

BRIEF DESCRIPTION OF THE DRAWINGS

Embodiments of the invention are herein described by way of example with reference to the accompanying drawings in which.

DETAILED DESCRIPTION OF EMBODIMENTS

The present invention will now be described more fully with reference to the accompanying drawings in which various embodiments are shown and described. It is to be understood that the invention may be embodied in many different forms and should not be construed as limited to the illustrated embodiments set forth herein. Rather, these embodiments are provided so that this disclosure will be thorough and complete, and will convey the scope of the invention to those skilled in the art.

Figure 1:
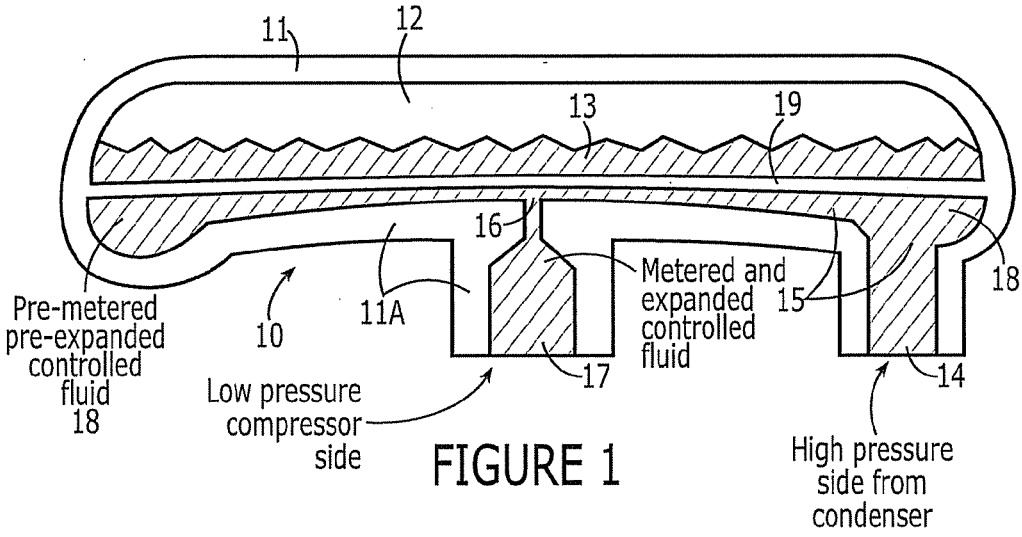
FIG. 1 is a partial diagrammatical cross-section view of one embodiment of the present invention including a flow control valve.

By way of example, and with reference initially to FIG. 1, one embodiment of the present invention includes a subcool control valve 10 comprising a single enclosure 11 having a sealed cavity 12 included therein. The cavity 12 contains a controlling fluid 13, generally a refrigerant that may be the same as the refrigerant to be controlled. The enclosure 11 may also contain a liquid refrigerant pathway for controlled fluid 18, the pathway including an inlet port 14, annulus 15, metering orifice 16, and outlet port 17. The annulus 15 distributes the controlled fluid 18 for essentially radial movement to orifice 16, for thereby bringing the controlled fluid 18 into thermal communication with the controlling fluid 13 via the thermally conductive flexible wall member 19 of the sealed cavity 11.

Thus, the controlling fluid 13 approaches the same temperature as the controlled fluid 18, such that the pressure within sealed cavity 12 is responsive to the temperature of the controlled fluid 18. A flexible wall member 19 separating the controlling fluid 13 from the controlled fluid 18 is responsive to a difference in the pressure of the controlled fluid 18 and pressure of the controlling fluid 13, all with the result that the flexible wall member 19 is responsive to the pressure and temperature of the controlled fluid 18. The pressure of the controlled fluid 18, in pathway including inlet port 14, annulus 15, metering orifice 16, and outlet port 17 is applied directly to one side of the flexible wall member 19, while pressure resulting from the temperature of the controlled fluid 18 is applied to the opposite side of the flexible wall member 19, via the controlling fluid 13 in the sealed cavity 12.

Figure 2:
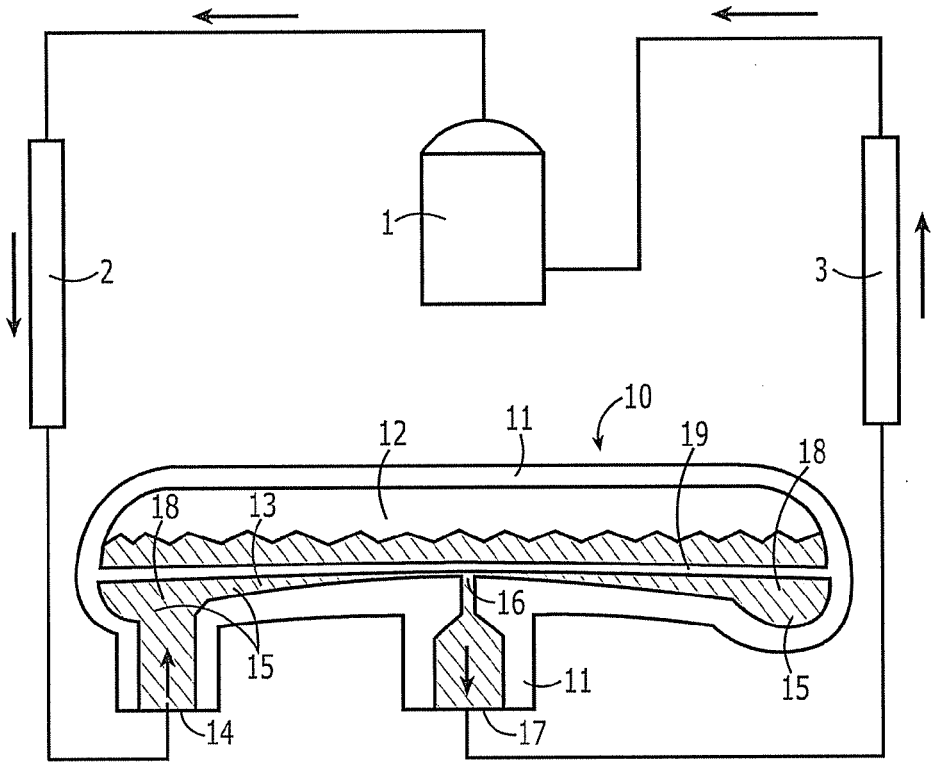
FIGS. 2 and 2A are partial flow diagrams illustrating the embodiment of FIG. 1 used with a refrigerant circuit, and a refrigerant circuit including a vapor control device, respectively.
Figure 2A:
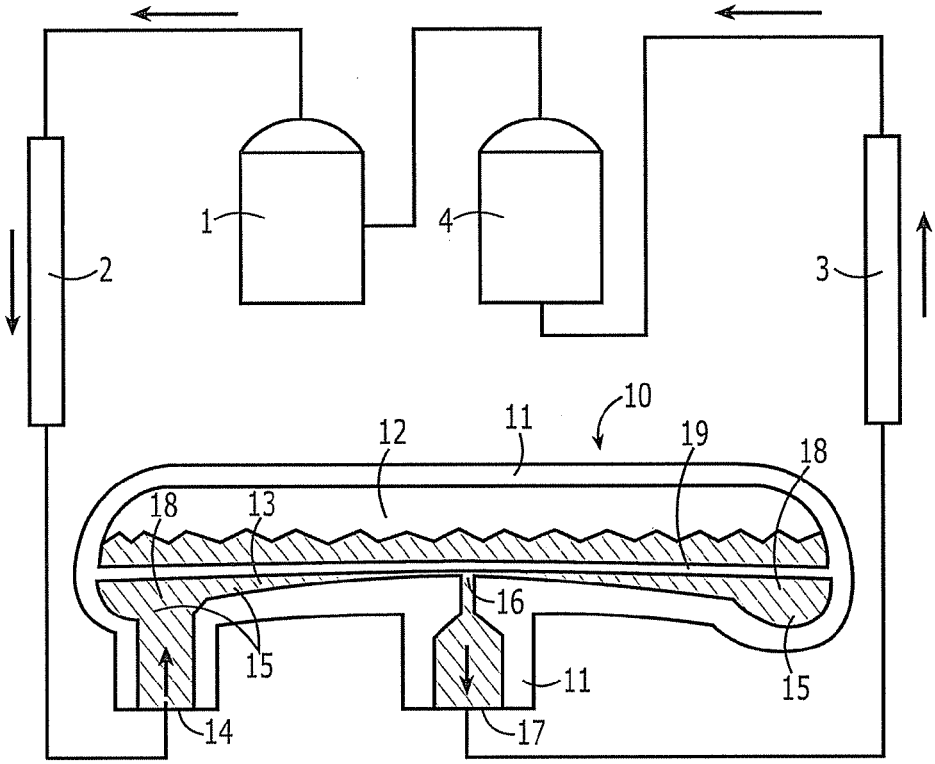

FIGS. 2 and 2A illustrates the subcool valve 10 connected within refrigerant circuits. Compressor 1 forces compressed refrigerant vapor into condenser 2, where it is condensed back to a liquid state, thereby delivering heat energy to the condenser 2. The liquid refrigerant leaving the condenser 2 becomes the controlled fluid 18, which enters subcool valve 10, at inlet port 14, and leaves at outlet port 17. The controlled fluid 18 then flows to an evaporator 3, where it extracts heat energy by evaporating, and thence to the compressor as a vapor. The operation of subcool valve 10 is as described above.

When the controlled fluid 18 is at its condensing temperature (zero subcool), the controlling fluid 13 will generally be at essentially the same temperature and will develop essentially the same pressure as the controlled fluid 18, and the pressures will therefore be essentially the same on both sides of the flexible wall member 19, which allows a portion of flexible wall member 19 to assume a position in relatively close proximity to metering orifice 16, which in turn allows a relatively small amount of the controlled fluid 18 to flow through the subcool control valve 10. This is the condition illustrated by way of example with reference to FIG. 2.

With continued reference to FIG. 2, when the controlled fluid 18 is cooler than its condensing temperature for example when the (controlled fluid 18 is subcooled), the pressure in the sealed cavity 12 will be reduced accordingly to correspond to the cooler temperature, thereby reducing the pressure in the sealed cavity 12 to a value less than the pressure of the controlled fluid 18, with the result that a portion of the flexible wall member 19 is displaced to a position farther from the metering orifice 16, to allow an increase in the rate of flow of the controlled fluid 18. This increased rate of flow through the metering orifice 16 reduces the amount of liquid refrigerant in the condenser 2 and thereby reduces the amount of subcooling. This is the condition illustrated with reference to FIG. 2. Operating equilibrium is reached when the flexible wall member 19 is displaced from the metering orifice 16 sufficiently to maintain a desired, pre-set, amount of subcooling in the condenser.

In an alternate embodiment, as illustrated with reference to FIG. 1A, the metering orifice 16 is operable with an expansion orifice 16A, wherein the controlled fluid 18 is metered as earlier described with reference to FIG. 1, then allowed to expand to become an expanding controlled fluid 18A as it passes through the expansion orifice 16A, and becomes metered and further expanded fluid 18B as it reaches outlet port 17. At the outlet 17 of the enclosure, the metered and further expanded refrigerant 18B is at a pressure essentially the same as in the evaporator.

By way of example with reference again to FIG. 1A, the length of bore of the expansion orifice 16A depends on the diameter of the bore, and the diameter of the expansion orifice may be in the range 60% to 100% of the diameter of the metering orifice 16. The shorter the bore of the expansion orifice 16A, the smaller its diameter. The length of the bore may be on the order of 7 times its diameter. By way of example, if the metering orifice diameter is 0.090", and the diameter of the expansion orifice is 0.050, the bore length of the expansion orifice 16A would be about 0.35". If, however the expansion orifice 16A diameter is 0.090 (i.e. simply an extension of the metering orifice 16), the length of the expansion orifice bore would be about 0.63". Having the controlled fluid 18 expand and chill a relatively large portion of enclosure 11 provides an improved inverse thermal feedback via enclosure 11.

Figure 1A:
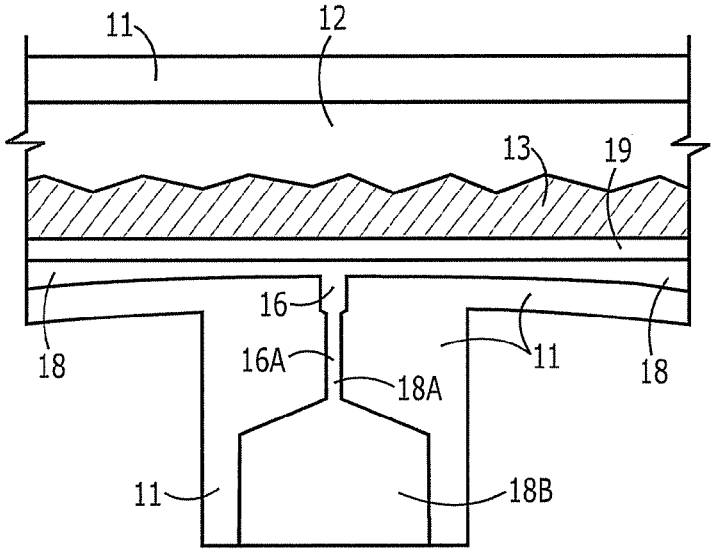
FIG. 1A is a partial enlarged cross sectional view of an alternate embodiment of FIG. 1 including a modified fluid flow path through the enclosure including a metering orifice followed by an expansion orifice.

With continued reference to FIG. 1A, after the controlled fluid 18 flows through metering orifice 16, it expands as it enters and flows through the expansion orifice 16A, and becomes the expanding fluid 18A. The expansion and partial evaporation (flash gas) of the expanding controlled fluid 18A causes it to become much colder, which in turn causes a larger portion of walls of the enclosure 11 adjacent the expansion orifice 16A to become colder. This temperature change is transmitted around the periphery of the enclosure 11 directly to the controlling fluid 13, including the vaporized portion of the fluid 13, and indirectly by way of walls of the enclosure 11, the controlled fluid 18 and flexible wall member 19, and thence to the controlling fluid 13, for providing an inverse thermal and enhanced stability to the operation of the valve 10.

With reference to the circuit of FIG. 2A, a vapor control device 4 is added to respond to conditions in the evaporator. The vapor control device 4 may be an active charge control, which may store liquid not in active circulation in the refrigerant circuit. When the vapor control device 4 is the active charge control, superheat at the evaporator outlet will be at or near zero, while subcooling in the condenser 2 is held at a pre-determined, generally low value, thereby providing that essentially all the inactive liquid refrigerant in the system will reside within the vapor control device 4 when the system is in normal operation.

Figure 3:
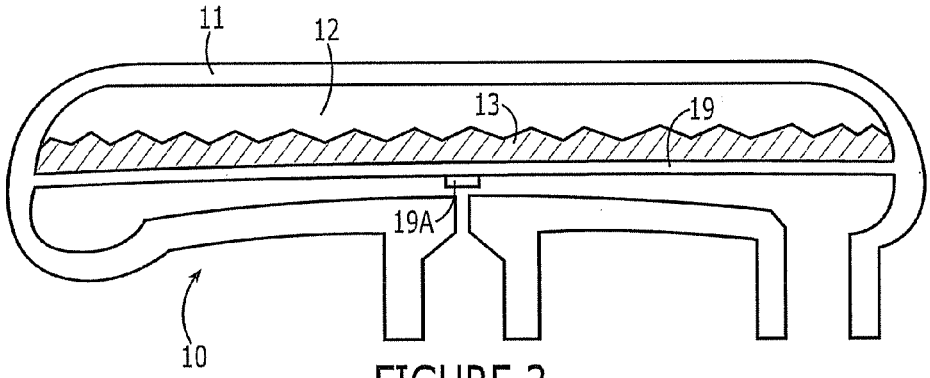
FIG. 3 is a partial diagrammatical cross sectional view of an alternate embodiment of the flow control valve of FIG. 1.

With reference to FIG. 3, an extension 19A may be formed as the flexible wall member 19 and serve to extend a movable portion of the member 19 as desired. The subcool control valve 10 reaches equilibrium when the pressure differential across the flexible wall member 19 displaces a portion of flexible wall member 19 from the metering orifice 16 sufficiently to maintain a desired amount of subcooling in the condenser 2. The desired amount of subcooling may be predetermined and set by adjusting the thickness and/or the flexibility of the flexible wall member 19 and the initial displacement of flexible wall member 19, or extension 19A, from the orifice 16, when the pressure differential across the member 19 is zero. As will come to mind of those skilled in the art, now having the benefit of the teaching of the present invention, other measures for setting the pre-determined amount of subcooling may be used.

The Subcool control valve 10 may be inherently stable for many applications, especially where system loading is reasonably constant, and without sudden or rapid pressure changes. However, in some applications, erratic system operating conditions, including extreme or rapid loading changes, may cause a subcool valve to "hunt", or even shut the system down.

By way of example, and with reference again to FIG. 2, an extreme or rapid load change results in far less than the desired amount of subcooling, the subcool valve 10 starts to close to increase subcooling in the condenser 2. This closing reduces the rate of liquid flow to the evaporator 3 which in turn reduces the mass flow through the compressor 1, which further reduces the amount of subcooling in the condenser 2, which then requires the subcool valve 10 to close even farther. This process can continue to result in severe overcorrecting in the closing phase, resulting in hunting, and can even "snowball" to completely close the valve, resulting in a system shutdown due to low compressor inlet pressure. Conversely, when an extreme or rapid load change results in far too much subcooling in the condenser 2, subcool valve 10 starts to open to reduce subcooling. This opening of the valve 10 increases the rate of flow to the evaporator 3, increases the mass flow through the compressor 1, which further increases subcooling in the condenser 2, which then requires the subcool valve 10 to open even farther. This process can continue to result in severe overcorrecting in the opening phase and thereby contribute to hunting. Conventional subcool valves are particularly susceptible to similar instability for the same reasons.

Figure 4:
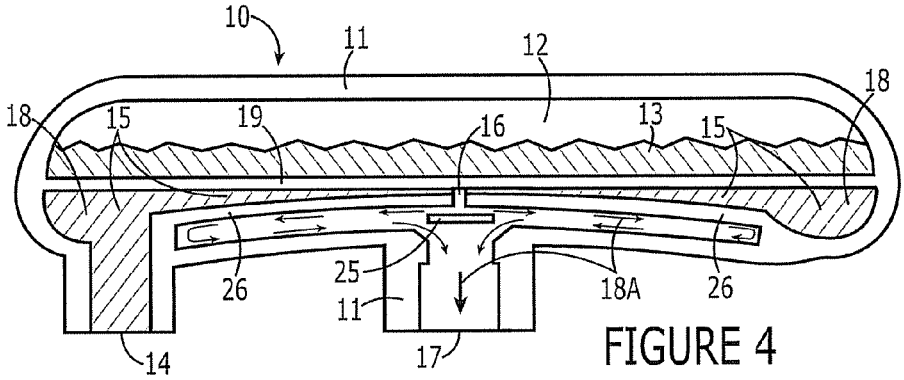
FIGS. 4, 4A, and 4B are partial cross sectional views illustrating alternate embodiment of a flow control valve including a chamber useful for enhancing inverse thermal feedback and stabilizing valve performance.

By way of further example and with reference to FIG. 4, one embodiment including an inverse thermal feedback signal used to further stabilize the subcool valve 10 is illustrated. The controlled fluid 18, after passing through metering orifice 16, is deflected radially outward by deflector disc 25 for passing into a metered flow chamber 27. The controlled fluid 18 now a metered fluid 18A, is brought into contact with supporting plate 26, which is herein presented as a thermally conductive disc, thus placing the metered fluid 18A in thermal communication with the controlling fluid 13 via the supporting plate 26, the controlled fluid 18, and the flexible wall member 19. When the valve 10 is in a closing phase of operation, the controlled fluid 18 and the metered fluid 18A becomes colder, which via supporting plate 26, the controlled fluid 18, and the flexible wall member 19 causes the controlling fluid 13 to become cooler, thereby reducing the pressure in the sealed cavity 12, to oppose and limit the amount of closure of the valve 10, and to thereby prevent over-correction, hunting, and possible shutdown of the refrigerant system within which the valve 10 is operable. In the opening phase of operation of the subcool valve 10, the controlled and metered fluid 18A become warmer, with the result that the controlling fluid 13 becomes warmer, thus increasing the pressure in sealed cavity 12 to oppose and limit the amount of opening of the valve 10 and thereby prevent over correction and hunting. The operation for the embodiment illustrated with reference to FIG. 4, may otherwise generally be described as earlier described for the embodiment of FIG. 1. The controlled fluid 18 enters at the inlet 14 and leaves at the outlet 17. The term "inverse thermal feedback" herein refers to the fact that as the controlling fluid 13 becomes warmer due to operating conditions, the controlled fluid 18 becomes colder after being metered, and a "colder signal" is communicated back to the controlling fluid to slow the action of the controlling fluid 18. The converse applies when the controlling fluid 13 becomes colder due to operating conditions.

Figure 4A:
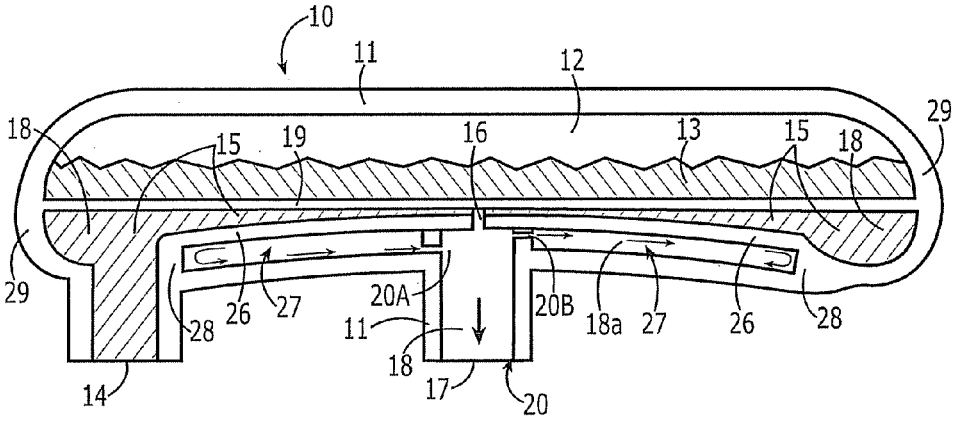

By way of further example and with reference now to FIG. 4A, one desirable inverse thermal feedback is realized by having the metered fluid 18A flowing into the metered flow chamber 27 through holes 20A, 20B within walls of the exit tube 20. The metered flow chamber 27, formed by the supporting plate 26 and the enclosure 11, is chilled, in the closing phase of operation, by this small amount of metered fluid 18A passing through the chamber 27, with a result that the supporting plate 26 transmits a chilling feedback through the controlled fluid 18 to the controlling fluid 13 within the sealed cavity 12. The now chilled periphery 28 of the chamber 27 transmits a chilling feedback around the periphery 29 of the enclosure 11 directly to the controlling fluid 13, and indirectly to the controlling fluid 13 through the flexible wall member 19. Conversely, in the opening phase of operation, the chilling feedback is greatly reduced, all to reduce overshooting and hunting. In variations of embodiments tested, it was found that a single hole 20A, by way of example, was also effective in allowing a small amount of metered fluid 18A to percolate into and out of the chamber 27 and return to the controlled fluid 18 at the outlet port 17. Thus one or more holes may be employed as desired for the embodiment being used.

Figure 4B:
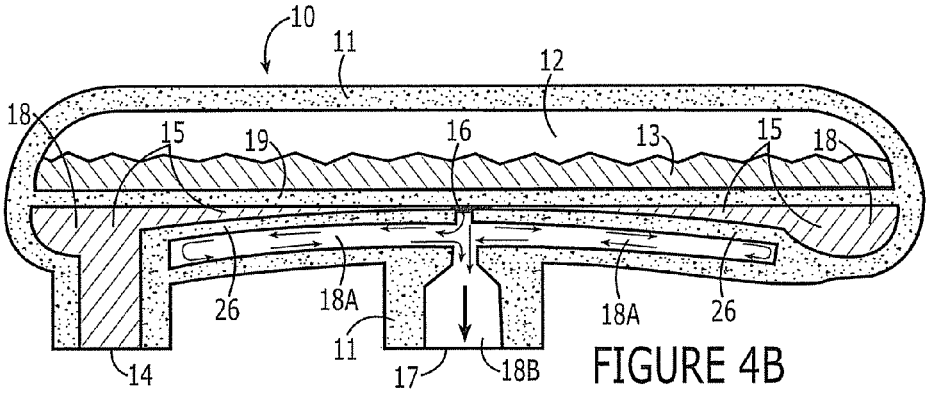

For the embodiment illustrated with reference to FIG. 4B, the operation of the valve 10 is essentially the same as described for the valve of FIG. 4A. Some of the metered refrigerant 18A circulates within the cavity formed by supporting plate 26 and the lower portion of enclosure 11, to thereby provide inverse thermal feedback and improve stability by reducing overshooting and hunting of the subject subcool control valve.

Figure 5:
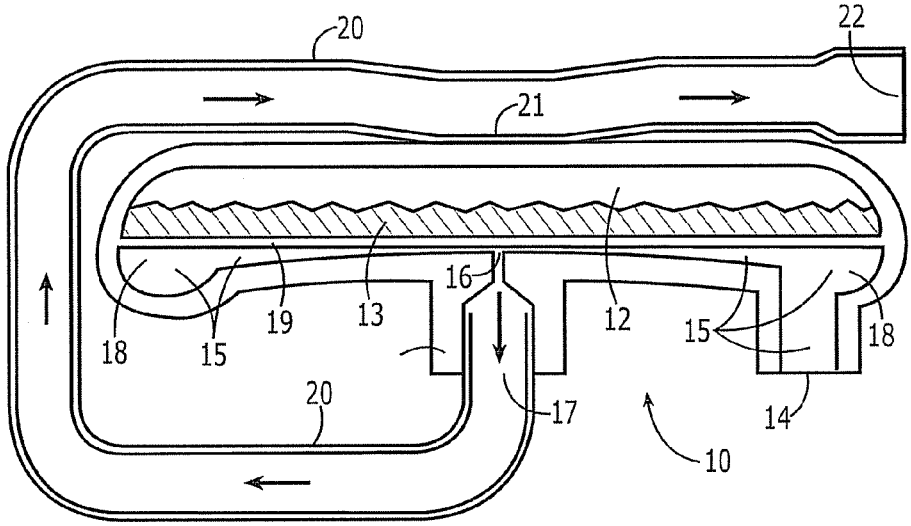
FIG. 5 is a partial cross sectional view of a flow control valve illustrating an alternate configuration for obtaining inverse thermal feedback.

FIG. 5 yet illustrates another embodiment whereby an inverse thermal feedback signal may be used to further stabilize the subcool valve 10. Exit tube 20 has thermal communication with the controlling fluid 13 in the sealed cavity 12, by way of thermal contact with the subcool control valve 10 at contact point 21. During the closing phase of subcool valve 10, the valve may tend to close too far as above described. As the valve closes the pressure and temperature in tube 20 decreases. This decrease in temperature is communicated to the fluid 13, particularly the vapor phase of fluid 13, in sealed cavity 12, thereby reducing the pressure in the sealed cavity and reducing the amount of closing of the valve, to eliminate overcorrecting in the closing phase of operation. Conversely, in the opening phase of the valve, the temperature in the exit tube 20 increases and this increase in temperature is communicated to the controlling fluid 13, thereby increasing the pressure in cavity 12 and eliminating overcorrecting in the opening phase of operation. The operation of this arrangement is otherwise the same as described relative to FIG. 1. The controlled fluid enters at inlet port 14 and leaves at the outlet port 22.

Figure 6:
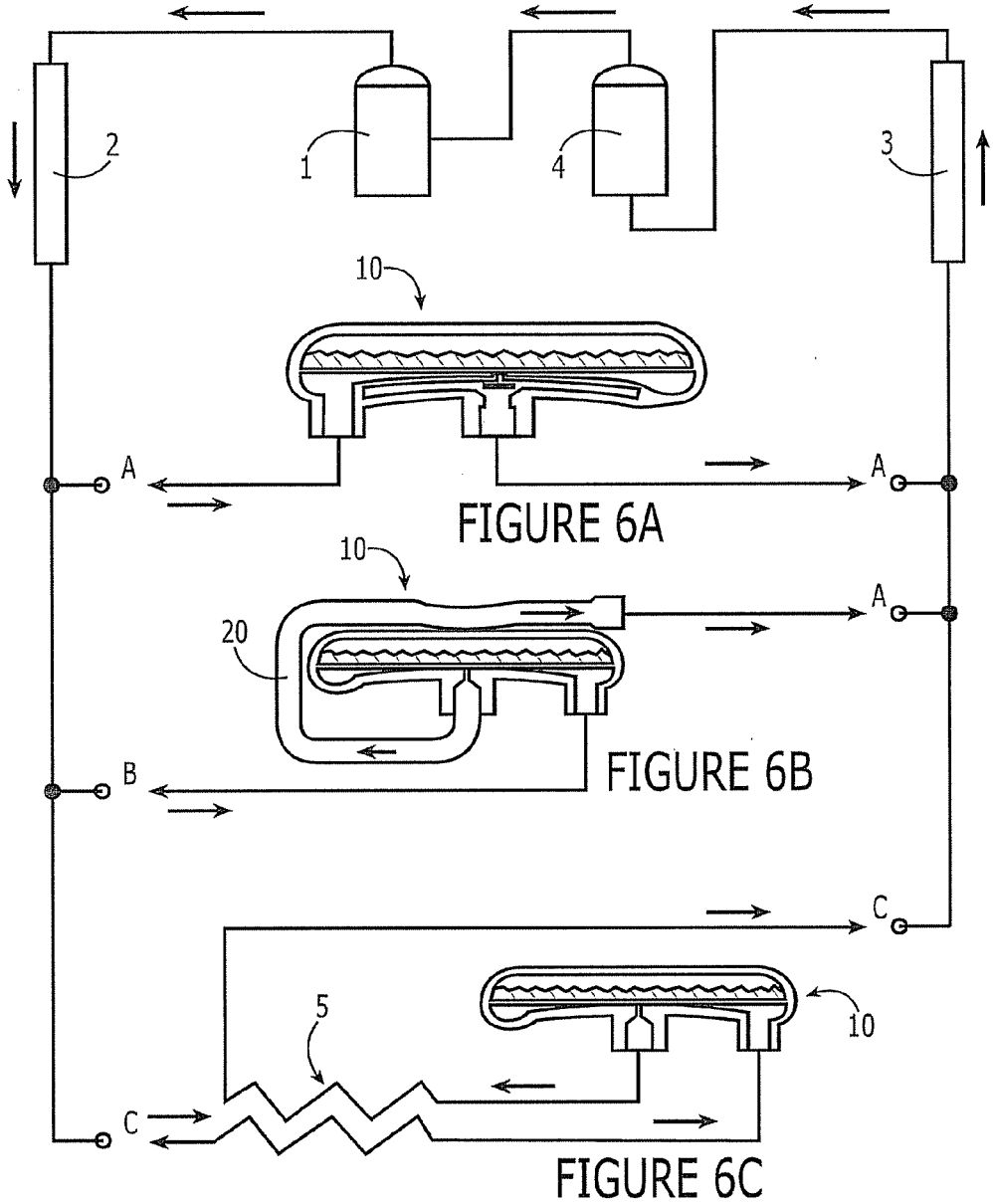
FIG. 6 is a diagrammatical illustration of the multiple embodiment of the flow control valve used in a refrigerant circuit.

FIG. 6 illustrates how versions of the subcool valve 10 in FIGS. 4 and 5 may be connected in refrigerant circuits 6A and 6B where stabilization is needed or desired. By way of example, when circuit 6A is used, connections are made at only A. By way of further example, when circuit 6B is used, connections may be made at B and B only. Circuit 6C illustrates the basic subcool valve of FIG. 1 coupled to a heat exchanger 5, to achieve inverse thermal feedback for stabilizing the circuit. When circuit 6C is used, connections are made at C and C only, by way of further example. With any of the three circuits of FIG. 6 connected, the compressor 1 forces hot refrigerant vapor into condenser 2, where it is condensed to a liquid state, thereby delivering heat energy at the condenser. The liquid then proceeds to the selected circuit for metering at 6A, 6B, or 6C. In circuits 6A and 6B inverse thermal feedback is accomplished as previously described. The metered liquid proceeds to evaporator 3 where it extracts heat energy and evaporates back to a vapor state. The refrigerant then proceeds to accumulator or active charge control 4, and thence to the compressor as a vapor.

In circuit 6C, the liquid leaving the outlet of subcool valve 10 proceeds through a heat exchanger 5 where it imparts inverse thermal feedback to the liquid moving from the condenser to the inlet of subcool valve 10. When valve 10 is in the closing cycle due to inadequate subcooling, the liquid at its outlet becomes colder which in turn makes the liquid arriving at its inlet cooler, which communicates to controlling fluid 13 that some subcooling has been achieved, thereby slowing the closing process to prevent overcorrecting in the closing operation. In the opening cycle converse actions occur to prevent overcorrecting in the opening cycle.

Figure 7:
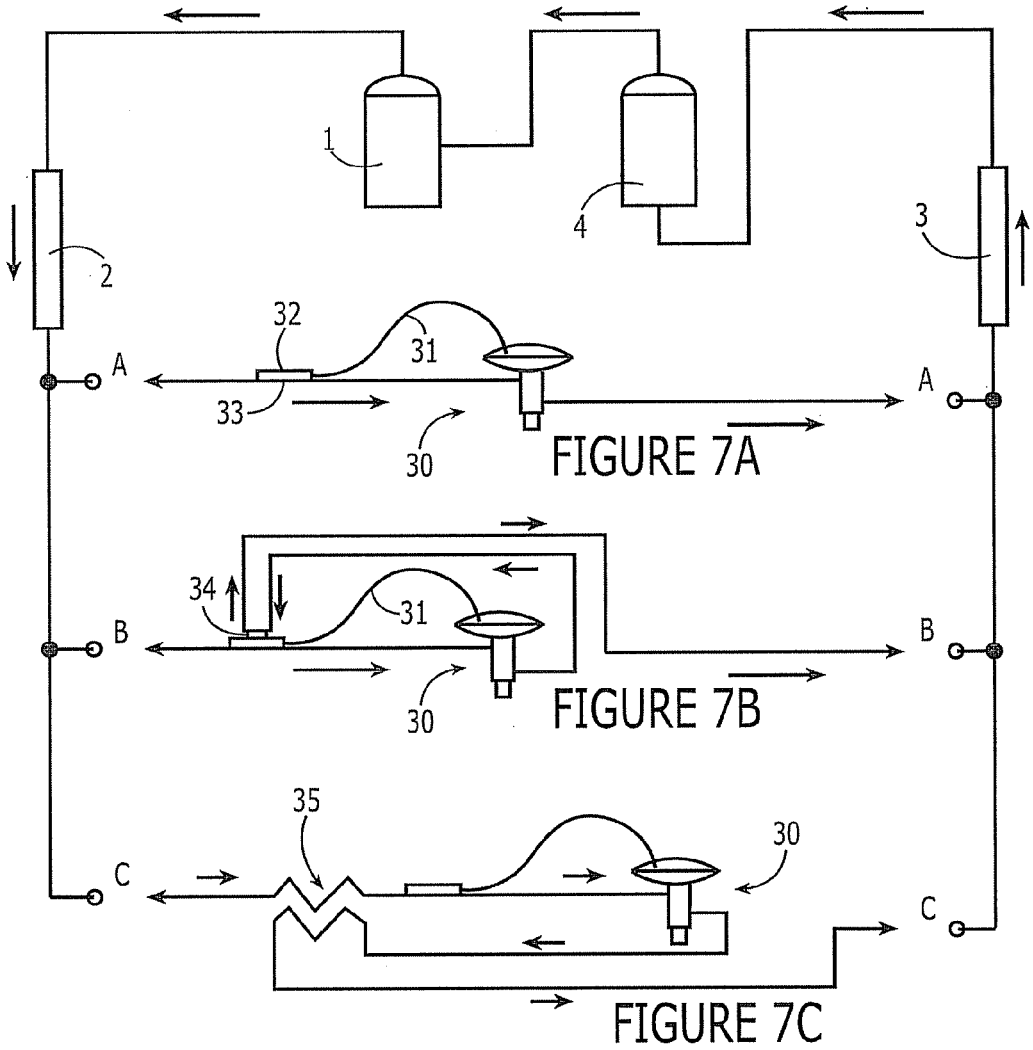
FIG. 7 is a diagrammatical illustration of the an inverse thermal feedback within a refrigerant circuit using conventional flow control valves.

FIG. 7 illustrates the application of inverse thermal feedback using a conventional subcool control valve. Circuit 7A, applicable when connections are made only at A, illustrates one application of a conventional subcool valve. Sensing bulb 32 makes thermal contact 33 with the liquid line between the condenser 2 and subcool valve 30. In some applications the conventional subcool valve may be unstable in this conventional configuration. In circuit 7B, applicable when connections are made at B and B, the liquid line leaving conventional valve 30 makes thermal contact 34 with sensing bulb 32, to provide inverse thermal feedback to eliminate over-correction and hunting in conventional valve 30. In circuit 7C, liquid leaving conventional valve 30 provides inverse thermal feedback via a heat exchanger 35, to prevent over-correction and hunting of the subcool valve 30.

Figure 8A:
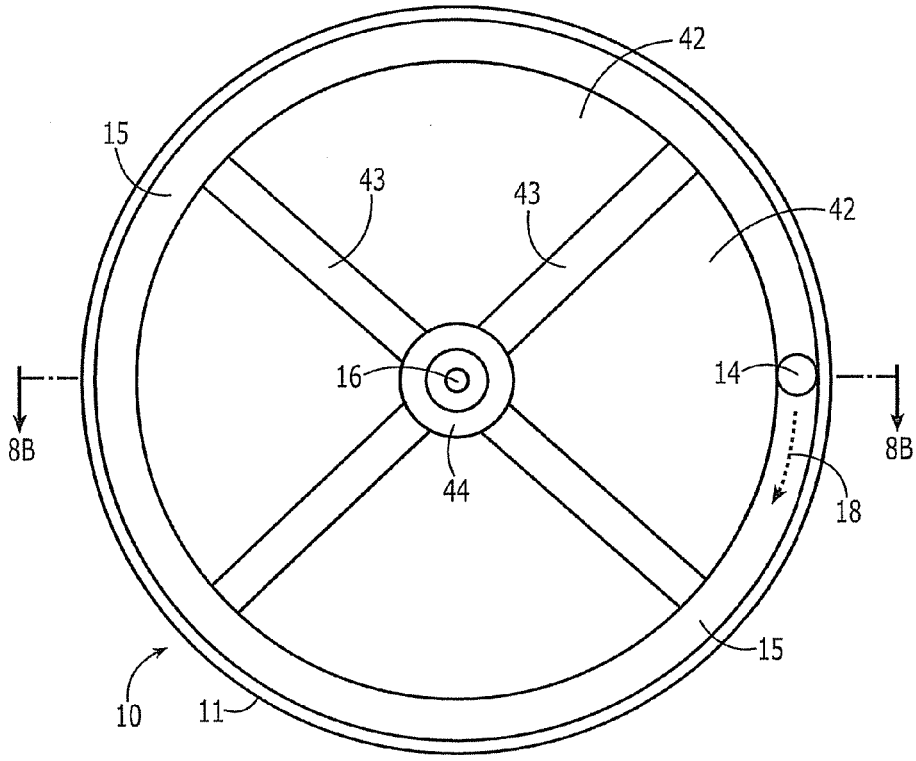
FIGS. 8A and 8B, 8C and 8D are partial top plan and cross sectional views, respectively, illustrating a valve structure having inverse thermal feedback useful in stabilizing valve performance.
Figure 8B:
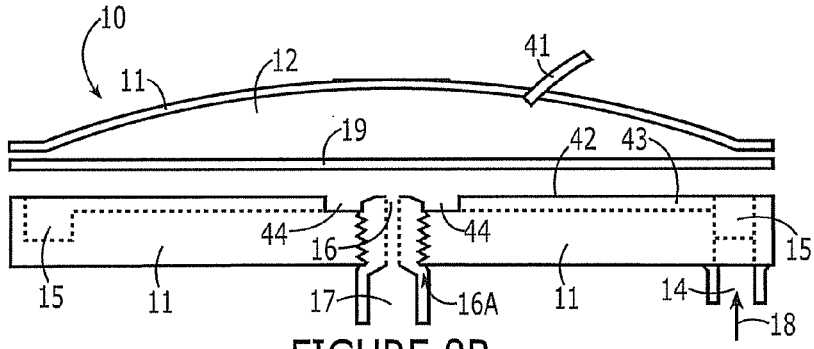
Figure 8C:
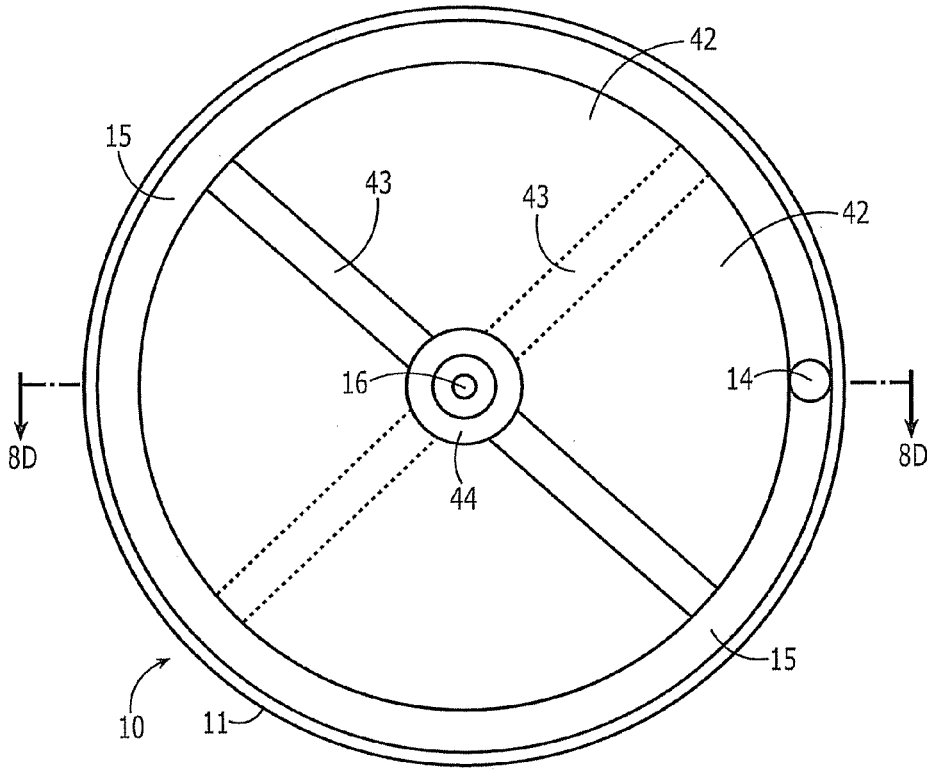
Figure 8D:
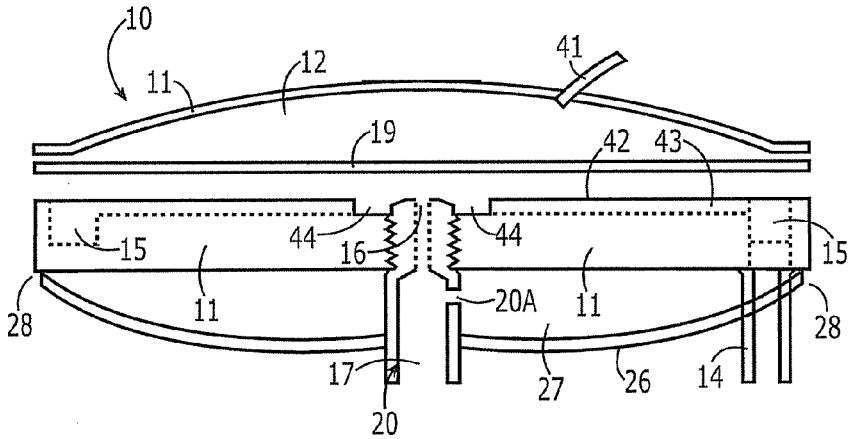

By way of further example with reference to FIGS. 8A and 8B, an exploded view of an alternative embodiment of the subcool control valve 10 will herein be described. The controlled fluid 18 enters through the inlet 14 then flows into outer annulus 15, in two directions to reach all fluid flow grooves 43, and thence into inner annulus 44. The controlled fluid 18 is then metered at metering orifice 16, and flows out of the valve 10 through the outlet 17. Support plateaus 42 support the movable member 19 and prevent warping of the flexible wall member 19, when there is no fluid or pressure present in the controlled fluid path. As earlier described, the valve is installed in a refrigerant circuit. While only four fluid grooves 43 are shown, many may be used for enhancing thermal contact between the controlled fluid 18 and the flexible wall member 19. The support plateaus 42 and the fluid flow grooves 43 may be provided with a radially corrugated lower portion of enclosure 11. For circuits where only a small amount of thermal feedback is needed for stability, the relatively long bore of orifice 16, as shown in FIG. 8B, provides both metering and expansion of the controlled fluid. Sizing the metering orifice 16 may include changing a screw-in fitting 16A that comprises outlet port 17 and orifice 16. Charging tube 41 is used for placing a predetermined amount of the controlling fluid 13 into the sealed cavity 12.

Where increased inverse thermal feedback is desired, the embodiment illustrated with reference to FIGS. 8C and 8D may be used. The metered and expanded fluid 18A percolates into and out of the feedback chamber 27 through hole 20A within walls of the exit tube 20. The feedback chamber 27, formed by the chamber plate 26 and the enclosure 11, is chilled by this small amount of metered and expanded fluid passing through the chamber 27, with a result that enclosure 11 and the chamber plate 26 transmits a chilling feedback to the controlling fluid 13 within the sealed cavity 12. With reference again to FIG. 1 by way of example for other related drawings, it is useful to note that the portion of the enclosure 11A proximate the orifice 16 and on the orifice side of the pathway includes a sufficient amount of thermally conductive material to provide the desired inverse thermal feedback.

The now chilled periphery 28 of the chamber 27 transmits a chilling feedback around the periphery of the enclosure 11 directly to the controlling fluid 13, and feedback is transmitted indirectly to the controlling fluid 13 through the bottom portion of enclosure 11, controlled fluid 18, and the flexible wall member 19.

In variations of embodiments tested, it was found that while multiple holes may be used, a single hole 20A, was also effective in allowing a small amount of metered fluid 18A to percolate into and out of the chamber 27 and return to the controlled fluid 18 at the outlet port 17. Thus one or more holes may be employed as desired for the embodiment being used. Operation of the valve 10 of FIGS. 8A and 8B, and in 8C and 8D are as earlier described with reference to FIGS. 1, 1A, 2, 2A, and 3.

Figure 9:
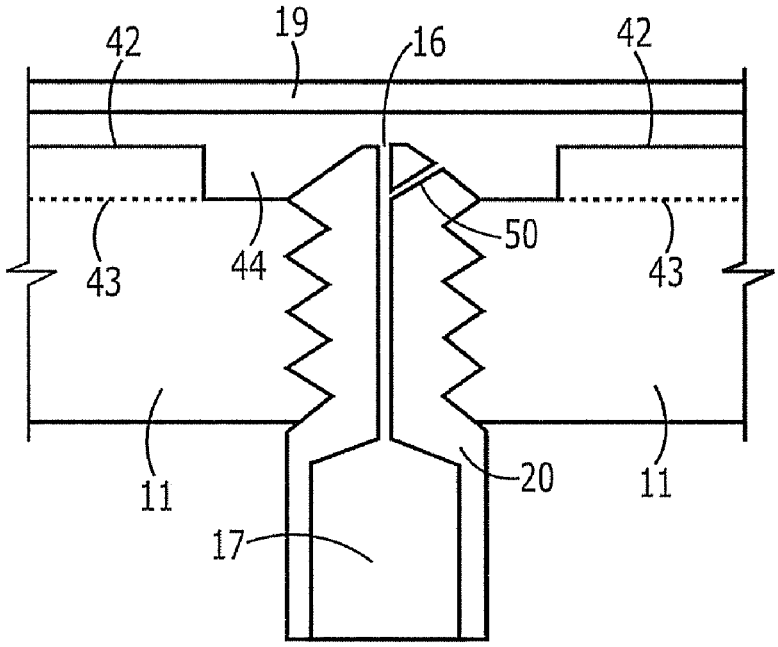
FIG. 9 is a partial diagrammatical cross sectional view of an embodiment including a removable orifice device which provides means for sizing the metering of the embodiments in FIGS. 8A, 8B, 8C, and 8D, and further shows use of an additional bypass orifice useful for enhancing stability and preventing shut-down down of the refrigerant circuit as a result of complete or sudden closure of the metering orifice.

With reference to FIG. 9, another feature that is useful in stabilizing a subcool control is a minimum flow bypass orifice 50, which allows a minimum flow of refrigerant even when the primary metering orifice 16 is fully closed. The minimum flow orifice 50, prevents shutdown of the refrigerant system resulting from the valve 10 closing completely or too quickly during the closing phase of the valve operation, and may prevent overshooting in both the opening and closing phases of the valve operation. The bypass orifice 50 reduces the destabilizing "pull-down" force exerted on flexible member 19. The pull-down force is due to reduced pressure of the controlled fluid 18, on member 19 above and adjacent the metering orifice 16. The bypass orifice 50 allows the pressure of the controlled fluid 18 above and adjacent the orifice 16 to increase to more closely approach the pressure of the controlled fluid 18 before it reaches the vicinity of metering orifice 16, thereby reducing the amount of destabilizing pull-down force. The bypass orifice 50 may be sized to provide about 20 percent to 25% of the total cross-sectional area (CSA) provided for flow of the controlled fluid 18. For example, if 25% is used and the orifice 16 has a diameter of 0.080", its CSA is 0.005027 square inches, 25% of 0.005027 is a CSA of 0.001257 square inches, and the diameter of the bypass orifice 50 is 0.040". Such a combination of the orifice 16 and the orifice 50 may replace a single metering orifice 16 with a diameter of 0.089", thereby providing additional stability to a subcool control valve.

By way of further example with continued reference to FIG. 9 in a refrigerant circuit for heating or cooling a fluid, the minimum flow bypass orifice 50 may be included in the subcool control valve, and may be incorporated into the screw-in fitting 16A described earlier with reference to FIGS. 8B and 8D, for improving stability of the subcool control valve.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of claims supported by this disclosure.

That which is claimed is:

1. A flow control valve comprising:

an enclosure having an inlet port and an outlet port for providing a fluid flow of a controlled fluid within a pathway extending therebetween;

a sealed cavity formed by only a thermally conductive single flexible wall member and the enclosure, the cavity formed within the enclosure for carrying a controlling fluid therein, wherein one side of the flexible wall member is in contact with the controlling fluid and an opposing side of the flexible wall member is in contact with the controlled fluid during operation of the valve as the controlled fluid flows through the pathway, and wherein pressure within the sealed cavity is responsive to temperature of walls forming the sealed cavity; and an orifice in the pathway positioned immediately proximate the flexible wall member, wherein the wall member makes direct physical contact with an orifice entrance when the orifice is in a fully closed position, and wherein the flexible wall member is away from the orifice entrance when in an open position, thereby forming a metering orifice directly responsive to the position of the flexible wall member relative to the orifice entrance, and wherein a decrease in temperature of the controlled fluid in the pathway results in a decrease in temperature and pressure of the controlling fluid thereby causing the pressure in the sealed cavity to decrease when the controlled fluid becomes cooler, thus causing the flexible wall member to move farther away from the metering orifice and increase a rate of fluid flow therethrough, and further causing the pressure in the sealed cavity to increase when the controlled fluid becomes warmer, thus causing the flexible wall member to move closer to the metering orifice and decrease the rate of fluid flow therethrough, with a result that the rate of the flow of the metered controlled fluid is determined by the temperature of the controlled fluid relative to the pressure of the controlled fluid for controlling a subcooling of the controlled fluid at the inlet port.

2. The flow control valve of claim 1, further comprising inverse thermal feedback means formed as part of the enclosure for stabilizing operation of the valve, wherein the inverse thermal feedback means comprises means for transmitting a thermal signal from the metered controlled fluid leaving the outlet port to the controlling fluid, wherein a thermal signal from the outlet port is small compared to the thermal signal from the controlled fluid and operates to oppose the thermal signal from the controlled fluid, thereby providing the inverse thermal feedback for stabilizing the flow control valve.

3. The flow control valve of claim 1, further comprising inverse thermal feedback means, the inverse thermal feedback means including the outlet port formed to make sufficient thermal contact with the enclosure wherein the expanded controlled fluid leaving the outlet port conveys a thermal signal to adjacent enclosure portions and thus with the controlled fluid within the pathway and to the controlling fluid by way of the controlled fluid within the pathway, the orifice providing passage of metered controlled fluid to the outlet, the outlet port positioned in thermal contact with the enclosure for providing thermal feedback to the controlled fluid within the pathway and thus to the flexible wall member which in turn provides inverse thermal feedback to the controlling fluid within the sealed cavity to thereby stabilize the valve.

4. The flow control valve of claim 2, wherein the inverse thermal feedback means comprises a conduit conveying the controlled fluid from the outlet port, wherein the conduit makes thermal contact with a portion of the enclosure that confines the controlling fluid, thereby transmitting an inverse temperature signal from the metered controlled fluid to the controlling fluid in the sealed cavity for stabilizing the flow control valve.

5. The flow control valve of claim 2, wherein the inverse thermal feedback means comprises a chamber carried by the enclosure wherein only a relatively small portion of the metered controlled fluid is carried therein for providing thermal feedback to the enclosure from the metered controlled fluid prior to passing through the outlet port.

6. The flow control valve of claim 5, wherein the chamber is formed by a plate and an outside wall surface of the enclosure, and wherein at least one hole extends from the outlet port into the chamber for permitting flow of the metered and expanded controlled fluid into and out of the chamber.

7. The flow control valve of claim 6, further comprising a deflector plate positioned downstream the metering orifice for diverting the metered controlled fluid into the chamber.

8. The flow control valve of claim 2, wherein the inverse thermal feedback means comprises a conduit extending from the outlet port for delivering the metered and expanded controlled fluid from the control valve, and wherein the conduit makes direct thermal contact with a wall of the enclosure for providing thermal feedback to the controlling fluid carried within the sealed cavity.

9. The flow control valve of claim 1, wherein the enclosure comprises:

an inner annulus positioned proximate the entrance to the orifice, wherein the orifice is positioned to discharge the controlled fluid into the outlet port;

an outer annulus proximate a periphery of the enclosure and generally paralleling the periphery, the outer annulus having the inlet port extending therein; and a fluid pathway extending from the outer annulus to the inner annulus for permitting the controlled fluid to pass from the inlet port to the outlet port.

10. The flow control valve of claim 1, further comprising:

a fitting extending into the enclosure, wherein the fitting forms the metering orifice and includes a flow bypass orifice, the flow bypass orifice including one of an extension from the pathway directly to the outlet port and an extension from the pathway to the metering orifice downstream the entrance of the metering orifice, wherein at least a partial flow of the controlled fluid is allowed to pass through the outlet port even during complete closure of the metering orifice.

11. A flow control valve comprising:

an enclosure having an inlet port and an outlet port for providing a fluid flow of a controlled fluid within a pathway extending therebetween;

a thermally conductive, single flexible wall member secured directly to interior wall portions of the enclosure so as to form a cavity therein, wherein one side of the flexible wall member forms at least a portion of the pathway for contacting the controlling fluid and an opposing side of the flexible wall member is in contact with the controlled fluid; and an orifice in the pathway positioned immediately proximate the flexible wall member, wherein the flexible wall member makes direct physical contact with the orifice entrance when the orifice is in a fully closed position, and wherein the flexible wall is away from the orifice entrance when in an open position, thereby forming a metering orifice directly responsive to the position of the flexible wall member, wherein a decrease in temperature of the controlled fluid in the pathway results in a decrease in temperature and pressure of the controlling fluid thereby causing the pressure in the sealed cavity to decrease when the controlled fluid becomes cooler, thus causing the flexible wall member to move farther away from the metering orifice and increase a rate of fluid flow therethrough, and further causing the pressure in the sealed cavity to increase when the controlled fluid becomes warmer, thus causing the flexible wall member to move closer to the metering orifice and decrease the rate of fluid flow therethrough, with a result that the rate of the flow of the metered controlled fluid is determined by the temperature of the controlled fluid relative to the pressure of the controlled fluid for controlling subcooling of the controlled fluid at the inlet port, wherein the metering orifice extends through a wall portion of the enclosure at the outlet port for metering and expansion simultaneously throughout an axial length of the orifice to provide a metered and expanded controlled fluid exiting the control valve, and thus provide a predetermined amount of subcooling of the controlled fluid entering the inlet port and providing expansion of the metered controlled fluid exiting the control valve.

12. The flow control valve of claim 11, wherein the orifice is positioned at the outlet port, and wherein the outlet port is formed and positioned on a wall portion of the enclosure with sufficient thermal contact with the enclosure for providing inverse thermal feedback via the enclosure and the controlled fluid and thus to the controlling fluid within the sealed cavity, the inverse thermal feedback thus stabilizing operation of the valve.

13. The flow control valve of claim 11, further comprising a chamber carried by the enclosure, wherein a portion of the metered controlled fluid flows therein for providing thermal feedback to the enclosure from the metered and controlled fluid prior to passing through the outlet port.

14. The flow control valve of claim 13, further comprising a deflector plate positioned downstream the metering orifice for diverting the metered controlled fluid into the chamber.

15. The flow control valve of claim 11, further comprising a conduit extending from the outlet port for delivering the metered and expanded controlled fluid from the control valve, and wherein the conduit makes thermal contact with one of an outside wall of the enclosure proximate the sealed cavity and direct thermal contact with a wall of the sealed cavity for providing inverse thermal feedback to the controlling fluid carried within the sealed cavity.

16. The flow control valve of claim 11, further comprising a fitting extending into the enclosure, wherein the fitting forms a metering orifice, an expansion orifice, and a flow bypass orifice, the flow bypass orifice extending from at least one of the pathway directly to the outlet port and extending from pathway to the metering orifice downstream the entrance end, wherein at least a partial flow of the controlled fluid is allowed to pass even during complete closure of the metering orifice.

17. The flow control valve of claim 11, wherein the enclosure comprises:

an inner annulus positioned proximate an entrance to the metering orifice and the metering orifice positioned to discharge the controlled fluid into the outlet port;

an outer annulus proximate a periphery of the enclosure and generally parallel a periphery thereof, the outer annulus having the inlet port extending into the outer annulus; and a plurality of flow grooves within an inner surface of the enclosure extending from the outer annulus to the inner annulus for permitting the controlled fluid to pass from the inlet port to the outlet port, wherein the outer annulus, the inner annulus and the plurality of flow groves extending therebetween from the pathway for the controlled fluid.

18. The flow control valve of claim 11, further comprising a fitting extending into the enclosure, wherein the fitting forms the metering orifice, as a metering and an expansion orifice positioned proximate the outlet port.

19. A refrigerant circuit comprising a compressor, a condenser, an evaporator, an active charge control, and a subcool control valve, the subcool control valve including an enclosure with an inlet port and outlet port and a pathway therebetween for a flow of a controlled fluid therethrough, and a sealed cavity containing a controlling fluid, thereby providing means for controlling a rate of flow of the controlled fluid through the valve, the refrigerant circuit further including valve stabilizing means comprising a portion of the enclosure proximate the outlet port that provides a thermal signal from the controlled fluid at the outlet port to be transmitted directly to the sealed cavity, wherein the thermal signal present at the outlet port is transmitted back to the controlling fluid, to oppose a valve action caused by the temperature of the controlled fluid relative to the pressure of the controlled fluid, thereby stabilizing the valve, wherein the circuit maintains a pre-determined amount of liquid refrigerant and subcooling in the condenser and therefore all inactive, non-circulating, liquid refrigerant in the system resides within the active charge control, and wherein the amount of inactive liquid in the active charge control and the amount of subcooling in the condenser is pre-determined.

20. The circuit of claim 19, wherein the inverse thermal feedback means comprise a conduit extending from the outlet port of the subcool control valve and making direct thermal contact with a sensing bulb operable with the subcool control valve.

21. The circuit of claim 19, wherein the thermal feedback means comprise a heat exchanger to exchange heat between the controlled fluid going to the control valve and the controlled fluid leaving the control valve.

22. A method comprising:

providing a condenser for condensing a refrigerant vapor;

condensing the refrigerant vapor for providing a controlled fluid;

forcing the controlled fluid through a pathway between an inlet port and an outlet port of a control valve;

storing a controlling fluid within a sealed cavity proximate the pathway for providing thermal contact between the controlling fluid and thus with the controlled fluid forced through the pathway;

metering an amount of the controlled fluid exiting the pathway, the metering responsive to differences in pressures resulting from differences in temperatures between the controlling fluid and the controlled fluid;

expanding the controlled fluid within the control valve prior to the controlled fluid exiting the outlet port;

forcing the metered and expanded controlled fluid into an evaporator, wherein the liquid portion of the controlled fluid is converted to essentially an all vaporous state, and forcing the controlled fluid into and through an active charge control vessel, wherein all liquid refrigerant is trapped and all vaporized refrigerant passes onward to the compressor, thus forming the refrigerant vapor from the controlled fluid; and compressing the refrigerant vapor and forcing the compressed vapor to the condenser while maintaining a predetermined amount of active liquid refrigerant and subcooling in a condenser and maintaining a predetermined amount of inactive liquid refrigerant in the active charge control vessel, wherein the metering comprises bringing the controlled fluid into thermal contact with one side of a flexible wall member operable between the pathway and the cavity, wherein the flexible wall member responds to a difference in the temperature and thus the pressure of the controlling fluid relative to the temperature and thus the pressure of the controlled fluid, thereby providing movement of the flexible wall member toward and away from the metering orifice, and providing that the temperature of the controlled fluid is transmitted via the flexible wall to the controlling fluid, thereby making the pressure of the controlling fluid responsive to the temperature of the controlled fluid with the result that pressure increases in the cavity when the controlled fluid becomes warmer and the flexible wall moves closer to the metering orifice to reduce the rate of flow of the controlled fluid, and conversely the pressure in the cavity decreases when the controlled fluid becomes colder and the flexible wall moves farther from the metering orifice to increase the rate of flow of the controlled fluid, wherein the subcooling present in the controlled fluid, which is the temperature of the controlled fluid relative to the pressure of the controlled fluid, is held at a predetermined and pre-set amount of subcooling, and wherein the metering orifice comprises a metering orifice and an expansion orifice positioned proximate the outlet port to provide inverse thermal feedback and enhance stability of the control valve, and to deliver metered and expanded controlled fluid at the outlet port at a pressure as the pressure appropriate for forcing the controlled fluid onward to the evaporator.

23. The method of claim 22, further providing a chamber adjacent the pathway wherein a portion of the metered controlled fluid circulates, thus providing an enhanced inverse thermal feedback to the controlling fluid within the control valve.

24. The method of claim 22, further providing a flow bypass orifice operable with the outlet port for permitting a predetermined continuous flow of the controlled fluid from the pathway to the outlet port independent of a substantial amount of the metering of the controlled fluid so as to prevent total closure of the outlet port and the metering thereto, and to reduce a pressure differential during the metering, thus further stabilizing the control valve.

25. The method of claim 22, wherein the metering comprises bringing the controlled fluid into thermal contact with one side of a flexible wall member operable between the pathway and the cavity, wherein the flexible wall member responds to a difference in the temperature and thus the pressure of the controlling fluid relative to the temperature and thus the pressure of the controlled fluid, thereby providing movement of the flexible wall member toward and away from the outlet, and providing that the temperature of the controlled fluid is transmitted via the flexible wall to the controlling fluid, thereby making the pressure of the controlling fluid responsive to the temperature of the controlled fluid with the result that pressure increases in the cavity when the controlled fluid becomes warmer and the flexible wall moves closer to the outlet port to reduce the rate of flow of the controlled fluid, and conversely the pressure in the cavity decreases when the controlled fluid becomes colder and the flexible wall moves farther from the outlet port to increase the rate of flow of the controlled fluid, wherein the subcooling present in the controlled fluid, which is the temperature of the controlled fluid relative to the pressure of the controlled fluid, is held at a predetermined and pre-set amount of subcooling.

26. The method of claim 22, wherein the controlled fluid is metered and expanded to an extent that temperature and pressure at the outlet port is sufficient for maintaining a predetermined amount of subcooling and amount of the inverse thermal feedback, the orifice positioned to increase the inverse thermal feedback and enhance stability of the control valve, and to deliver metered and expanded controlled fluid at the outlet port at a pressure appropriate for forcing the controlled fluid onward to the evaporator.

27. The method of claim 22, wherein the metering includes expansion means positioned to increase inverse thermal feedback and enhance stability of the valve, and to deliver metered and expanded controlled fluid at the outlet port at essentially the same pressure as the pressure in the evaporator.

28. The method of claim 22, wherein the compressor, the condenser, and the evaporator operate as one of an air conditioner and a heat pump.

29. The method according to claim 22, further including an active charge control for maintaining all non-circulating, liquid refrigerant within the active charge control.

30. The method of claim 22, further comprising maintaining the amount of liquid refrigerant and subcooling in the condenser at a fixed pre-determined amount.

31. The flow control valve of claim 19, further comprising conduit means to place the metered controlled fluid in thermal communication with a wall of the cavity containing the controlling fluid so as to provide the inverse thermal feedback to the controlling fluid.

32. The flow control valve of claim 19, wherein the sealed cavity comprises a single flexible wall members sealed directly against a wall surface so as to form the sealed cavity.

33. The method of claim 22, wherein the metering and expanding of the controlled fluid comprise at least one of the metering and expanding of the controlled fluid to a pressure and temperature sufficient for a pre-determined amount of flow and subcooling of the controlled fluid, and the metering and expanding of the controlled fluid to a pressure appropriate for forcing the controlled fluid onward to the evaporator.

* * * * *